US008552326B2

(12) United States Patent
MacKay et al.

(10) Patent No.: US 8,552,326 B2
(45) Date of Patent: Oct. 8, 2013

(54) ELECTROSTATIC SEPARATION CONTROL SYSTEM

(75) Inventors: Bruce E. MacKay, Framingham, MA (US); Bulent Sert, Marblehead, MA (US)

(73) Assignee: Separation Technologies LLC, Needham, MA (US)

( * ) Notice: Subject to any disclaimer, the term of this patent is extended or adjusted under 35 U.S.C. 154(b) by 401 days.

(21) Appl. No.: 12/875,792

(22) Filed: Sep. 3, 2010

(65) Prior Publication Data

US 2012/0059508 A1 Mar. 8, 2012

(51) Int. Cl.
*B03C 7/00* (2006.01)

(52) U.S. Cl.
USPC ..... 209/127.1; 209/3; 209/11; 209/128

(58) Field of Classification Search
USPC ..... 209/127.1, 131, 509, 552
See application file for complete search history.

(56) References Cited

U.S. PATENT DOCUMENTS

| | | | |
|---|---|---|---|
| 1,110,896 | A | 9/1914 | Comstock |
| 1,222,305 | A | 4/1917 | Kraus |
| 1,355,477 | A | 10/1920 | Howell |
| 2,689,648 | A | 9/1954 | Maestas |
| 2,758,666 | A | 8/1956 | Prentiss |
| 2,776,725 | A | 1/1957 | Wood |
| 2,847,124 | A | 8/1958 | Brastad |
| 2,889,042 | A | 6/1959 | Le Baron |
| 3,022,889 | A | 2/1962 | Le Baron |
| 3,096,277 | A | 7/1963 | Maestas |
| 3,140,714 | A | 7/1964 | Murphy, Jr. et al. |
| 3,247,960 | A | 4/1966 | Brastad |
| 3,449,837 | A | 6/1969 | Giddings |
| 3,493,109 | A | 2/1970 | Carta et al. |
| 3,635,340 | A | 1/1972 | Dunn |
| 3,664,939 | A | 5/1972 | Luner et al. |
| 3,720,312 | A | 3/1973 | Shook et al. |
| 3,941,685 | A | 3/1976 | Singewald et al. |
| 4,122,002 | A | 10/1978 | Hauskins, Jr. |
| 4,137,156 | A | 1/1979 | Morey et al. |
| 4,172,028 | A | 10/1979 | Dunn |
| 4,297,207 | A | 10/1981 | Singewald et al. |
| 4,302,245 | A | 11/1981 | Winters |
| 4,358,358 | A | 11/1982 | Rhodes |
| 4,440,638 | A | 4/1984 | Judy et al. |
| 4,451,357 | A | 5/1984 | LaVigne |
| 4,476,004 | A | 10/1984 | Pohl |

(Continued)

FOREIGN PATENT DOCUMENTS

| | | |
|---|---|---|
| DE | 0705007 | 4/1941 |
| EP | 0109828 | 5/1984 |

(Continued)

OTHER PUBLICATIONS

Whitlock, D.R., "Electrostatic Separation of Unburned Carbon from Fly Ash," Proceedings Tenth Int. Ash Use Symposium, vol. 2, 1993, pp-70-1-70-2, XP002063618.

(Continued)

*Primary Examiner* — Terrell Matthews
(74) *Attorney, Agent, or Firm* — Lando & Anastasi, LLP

(57) ABSTRACT

A process control system, more particularly, a process control system for controlling electrostatic separation for the separation of particulate materials is provided.

70 Claims, 7 Drawing Sheets

(56) References Cited

U.S. PATENT DOCUMENTS

| | | | | | |
|---|---|---|---|---|---|
| 4,482,351 | A | | 11/1984 | Kitazawa et al. | |
| 4,517,078 | A | | 5/1985 | Inculet et al. | |
| 4,767,506 | A | | 8/1988 | Fricke | |
| 4,839,032 | A | * | 6/1989 | Whitlock | 209/3 |
| 4,874,507 | A | * | 10/1989 | Whitlock | 209/11 |
| 5,006,226 | A | | 4/1991 | Burt, Jr. | |
| 5,251,762 | A | | 10/1993 | Taylor et al. | |
| 5,299,692 | A | | 4/1994 | Nelson et al. | |
| 5,358,119 | A | | 10/1994 | Stahl et al. | |
| 5,449,390 | A | | 9/1995 | Duncan et al. | |
| 5,484,061 | A | | 1/1996 | Dunn | |
| 5,513,755 | A | | 5/1996 | Heavilon et al. | |
| 5,562,755 | A | | 10/1996 | Fricke et al. | |
| 5,819,946 | A | | 10/1998 | Whitlock et al. | |
| 5,829,598 | A | * | 11/1998 | Whitlock | 209/128 |
| 5,904,253 | A | * | 5/1999 | Cerullo et al. | 209/128 |
| 6,074,458 | A | * | 6/2000 | Bittner et al. | 95/60 |
| 6,375,875 | B1 | * | 4/2002 | Paulauskas et al. | 264/29.2 |

FOREIGN PATENT DOCUMENTS

| | | | |
|---|---|---|---|
| FR | 940389 | | 12/1948 |
| JP | 57 171454 | | 10/1982 |
| JP | 59 049858 | | 3/1984 |
| RU | 0495088 | | 3/1976 |
| RU | 0498042 | | 3/1976 |
| SU | 1007735 | | 3/1983 |
| SU | 1196033 | | 12/1985 |
| SU | 1475720 | | 4/1989 |
| WO | 8707532 | | 12/1987 |
| WO | 8909092 | | 10/1989 |
| WO | 97/20633 | A1 | 6/1997 |
| WO | WO 9720633 | A1 * | 6/1997 |
| WO | 2007/014402 | A1 | 2/2007 |
| WO | WO 2007014402 | A1 * | 2/2007 |

OTHER PUBLICATIONS

SME Mineral Processing Handbook—Norman L. Weiss, Pub. By Society of Mining Engineers of the American Institute of Mining, Metallurgical, and Petroleum Engineers, Inc., 1985, pp. 6-34.

Adamson, R.J. and Kaler, K.V.I.S., "An Automated Stream Centered Dielectrophoretic System," Conference Record of the 1986 IEEE Industry Applications Society Annual Meeting Part II, Sep. 28-Oct. 3, 1986, IEEE Catalog No. 86CH2272-3, pp. 1350-1354.

* cited by examiner

ELECTROSTATIC SEPARATION CONTROL SYSTEM

FIELD OF INVENTION

The present invention relates to process controls and, more particularly, to process controls for controlling electrostatic separation for the separation of particulate materials.

BACKGROUND

In principal, dissimilar conductive particles can be separated electrostatically by a variety of methods that are well documented in the literature. One type of electrostatic separation method that has achieved the greatest commercial success utilizes a triboelectric counter-current belt-type separator as disclosed in U.S. Pat. Nos. 4,839,032 and 4,874,507. Such belt separator systems separate the constituents of particle mixtures based upon the charging properties of the different constituents by surface contact, i.e. the triboelectric effect. These systems typically utilize parallel spaced electrodes arranged in a longitudinal direction, between which a belt travels in the longitudinal direction that forms a continuous loop as it is driven by a pair of end rollers. A particle mixture is loaded into the belt between the electrodes where it is subjected to the strong electric field generated by the electrodes. The net result is that the positively charged particles subjected to the electric field move towards the negative electrode and the negatively charged particles move towards the positive electrode. The counter-current action of the moving belt segments sweep the electrodes in opposite directions and transport the constituents of the particle mixture to their respective discharge points on either end of the separator. Ultimately, each particle is transferred toward one end of the system by the counter-current moving belt that produces a certain degree of separation of the particle mixture.

The most established application to date for the triboelectric counter-current belt-type separator system is the separation of unburned carbon from coal fly ash. Worldwide, tremendous quantities of pulverized coal are burned in boilers to produce steam that powers turbines for the generation of electricity. In the boiler, the carbonaceous constituents in the coal are burned to release heat, and the non-carbonaceous material remains and is collected as fly ash. The ash content of normal coals vary, but typically comprise about 10% of the overall coal content. As a result, fly ash is produced at very high volumes throughout the industrialized world. Historically, one of the major outlets for coal fly ash has been as an additive in concrete products as a replacement for a portion of the cement. Furthermore, fly ash addition results in enhanced concrete strength and resistance to chemical attack, thereby turning a waste material to a valuable by-product. However, the presence of unburned carbon in fly ash has limited usage in concrete since implementation of The Clean Air Act of 1990 which required power plants to cut nitric oxide emissions through a variety of approaches including significant boiler modifications. These changes have resulted in elevated levels of unburned carbon in the fly ash that has rendered most materials unusable in concrete production without additional processing to remove unburned carbon. The counter-current belt-type separator system has proven to be one of the most cost-effective and reliable methods for processing fly ash for carbon removal. This technology typically produces a low carbon fly ash product, plus a fly ash stream that is enhanced in carbon content. As discussed, the low carbon product is ideally suited for use in ready mix concrete applications. On the other hand, the high carbon content fly ash is a valuable by-product due to its high fuel value which can be returned directly to the boiler for burning with the incoming coal. Alternatively, high carbon fly ash can also be used in other combustion applications such as a secondary fuel to cement kilns.

SUMMARY

In accordance with one or more embodiments, a method for controlling processing of particulate materials using an electrostatic separation system is provided. The method comprises processing particulate material in an electrostatic separation system to recover a first stream that is diluted in at least one component of an incoming feed, and a second stream that is concentrated in at least one component of the incoming feed. The method also comprises determining at least one input variable of the electrostatic separation process and at least one output variable indicative of at least one property of the first stream to be controlled in the electrostatic separation system. The method further comprises measuring at time spaced intervals the at least one output variable from the electrostatic separation system, and selecting a target range for the at least one output variable. The method still further comprises comparing the measured output variable with the target range to generate an output signal, and adjusting the at least one input variable in response to a process based at least in part on the output signal.

In accordance with one or more embodiments, an apparatus for separating particulate mixtures is provided comprising a feed point configured to receive particulate material, an electrostatic separation system, a sensor in fluid communication with the particulate material and configured to measure an output variable of the particulate material; and a controller operatively coupled to receive an output signal from the sensor based at least in part on the measured output variable and control at least one input variable of the electrostatic separation system based at least in part on the output signal.

In accordance with one or more embodiments, a computer readable medium including computer readable signals stored thereon defining instructions that, as a result of being executed by a controller, instruct the controller to perform a method of controlling processing of particulate materials using an electrostatic separation system is provided. The computer readable medium comprises measuring at least one output variable, comparing the at least one output variable to a target range, generating an output signal based on the at least one output variable and the target range; and adjusting at least one input variable based at least in part on the output signal.

The control system can maintain the output parameters within the target range while processing to maximize the yield of the primary product of interest. The control system may also control the destination of the primary stream, in order to divert production to an off-quality location during periods when the product is not within specification for more than a predetermined period. Furthermore, the control system may redirect the destination of the primary stream back to the quality location, once system changes have returned the output quality back within the target range.

BRIEF DESCRIPTION OF THE DRAWINGS

The features, aspects and advantages of the present invention will become better understood upon consideration of the following drawings in which.

Figure 1:
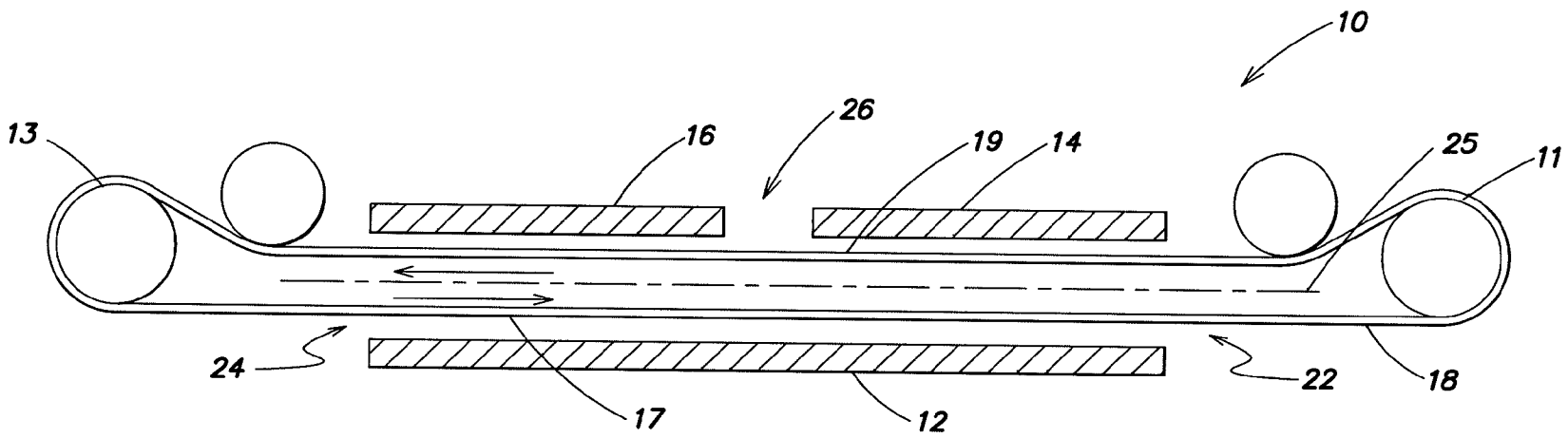
FIG. 1 is a cross-sectional view showing the general configuration of a counter-current belt-type separator system.

It should be understood that these drawings are not necessarily to scale and that details which may not be necessary or which render other details difficult to perceive may have been omitted. It should also be understood that the invention is not limited to the particular embodiments illustrated herein.

DETAILED DESCRIPTION

In the electrostatic separation of dissimilar materials using the electrostatic counter-current belt-type separator system, it is desirable to control certain output variables from the process in order to produce a consistent product quality. However, input variables and other unmeasurable physical parameters of the feed materials that effect processing frequently fluctuate and influence the output variables that are attempted to be controlled by the process. In some processing systems, product samples are taken at spaced intervals, for example, once every half-hour or hour of operation. The output variables of interest are measured for each sample. The operator then adjusts one or more of the input variables after each sample is tested, with the magnitude of each change determined by the difference between the sample value and the target range. The operator's adjustments are usually based upon their own experience with the particular system, in an attempt to try to bring the output variables back toward their goal values.

One problem with such known methods of controlling the electrostatic separation process is that the output variables are not controlled during the time intervals between sampling. Therefore, if changes in the input variables or other physical parameters of the electrostatic separation process cause the value of the output variables to move outside of the desirable range of values, the changes will not be detected until the next manual sample is taken. As a result, a substantial amount of the product produced may not fall within the customer specification. Yet another problem with such known methods of controlling the electrostatic separation process is that such methods rely on the subjective analysis of the operator in order to adjust one or more input variables, based upon the values of the laboratory measured output variables. As a result, input variable adjustments frequently may vary between operators and, therefore, result in inconsistent product quality. Furthermore, many times the inconsistent response of operators can adversely impact the product yield, as incorrect decisions and conservative operation lead to sub-optimal operation where valuable product is rejected with the impurities.

In an embodiment, the electrostatic separation process control system can compensate for variations in the input feed quality or other physical parameters of the electrostatic separation process by adjusting one or more of the input variables to the process, in order to control one or more output variables of the process, and thus produce a product stream of consistent quality.

In an embodiment, the control system can have broad capability and flexibility to handle a wide variety of input feed materials and separator geometries. Any dissimilar particulate mixtures can be separated, for as two particles contact, the particle with the higher work function gains electrons and becomes negatively charged while the particle with the lower work function losses electrons and becomes positively charged. The particulate mixtures or materials can comprise a first component at a first percentage of a total weight or volume of the particulate material and a second component at a second percentage of the total weight or volume of the particulate material, wherein the first percentage is greater than the second percentage. In addition to the separation of fly ash, the system can be used, for example, to separate flour from bran and concentrating concentrated fruit juices, as well as for the beneficiation of a variety of minerals, including industrial minerals, and ores. Specific mineral applications include the purification of calcium carbonate minerals comprising at least one of calcite, limestone, marble, travertine, tufa, and chalk through removal of quartz, graphite, pyrites, dolomite, mica, sulfides, other contaminants, and combinations thereof; dolomite materials through removal of tremolite, quartz, pyrite, other contaminants, and combinations thereof; talc minerals through removal of sulfides, calcite, dolomite, magnesite, pyrite, quartz, graphite, carbonates, tremallite, other contaminants, and combinations thereof; kaolin minerals through removal of iron, quartz, mica, other contaminants, and combinations thereof; and potash materials through removal of halite, kieserite, other contaminants, and combinations thereof. Although this provides an indication of the breadth of possibilities, the technology is not limited to only these applications, and has wide applicability where different particulate materials are present in discrete phases. As the separator processes the material, a first stream can be generated comprising a first component, such as calcium carbonate, and a second stream can be generated comprising a second component, such as a contaminant, for example quartz.

In an embodiment of the system, the control system can maintain product quality within a target specification, while simultaneously maximizing the yield of primary product. The control system can also automatically divert production of a primary stream to an off-quality location such as a tank or a reservoir when product quality has been outside of a target range for more than a predetermined period and return once back within specification, thus providing another means of assuring superior product quality compared to existing methods.

In one embodiment, a method of controlling processing of particulate materials using an electrostatic separation system is provided. This method can include processing particulate material as shown in FIG. 1.

In FIG. 1, an example of an electrostatic belt-type separation system 10, in which the process control system can be employed, is illustrated schematically. Belt separator system 10 includes parallel, spaced electrodes 12 and 14/16 arranged in the longitudinal direction defined by longitudinal centerline 25 and belt 18 traveling in the longitudinal direction between the spaced electrodes. The belt forms a continuous loop which is driven by a pair of end rollers 11, 13. A particle mixture or particulate material is loaded from a source of particulate material, such as a tank, reservoir, or silo onto the belt 18 at feed area 26, or feed point that is configured to receive particulate material, between electrodes 14 and 16. The source of particulate material can be from a system or process located upstream of the separation system. Belt 18 includes counter-current traveling belt segments 17 and 19 moving in opposite directions for transporting the constituents of the particle mixture along the lengths of the electrodes 12 and 14/16.

An electric field is created in a traverse direction between electrodes 12 and 14/16 by applying a potential to electrode 12 of polarity opposite to potential applied to electrodes 14/16. As the constituents of the particle mixture are transported along the electrodes by belt 18, the particles become charged and experience a force in a direction traverse to longitudinal centerline 25 of system 10, due to the electric field. This electric field moves the positively charged particle towards the negative electrode and the negatively charged particles towards the positive electrode. Ultimately, each particle is transferred to either the primary product removal section 24 or the secondary product removal section 22 depending on the charge of the particles and the polarity of the electrodes. In certain examples, a first component of the particulate material may charge negative and the second component of the particulate material may charge positive. In other examples, a first component of the particulate material may charge positive and the second component of the particulate material may charge negative. In any of these examples, the electrostatic separation system may operate with negative polarity on the top electrode panel and positive polarity on the bottom electrode panel, or positive polarity on the top electrode panel and negative polarity on the bottom electrode panel. A primary product effluent stream exits the system from primary product removal section 24, while a secondary product effluent stream exits the system from secondary product removal section 22. The charge that a particle develops determines which electrode it will be attracted to and, therefore, the direction in which the belt will carry the particle. The magnitude of the particle charging is determined by the relative electron affinity of the material, i.e. the work function of the particle. The greater the difference in work function between the discrete particulate materials, the greater the driving force will be for separation of the particles.

The overall effectiveness of the separation process can be influenced by many factors related to the feed constituent composition for the electrostatic separation process that typically varies continuously during the course of processing under normal industrial conditions. In addition, other environmental factors that may or may not be controllable can have a significant impact on the work function of the particles of the mixture and, hence, overall processability. These environmental factors include temperature and relative humidity of the feed mixture, as discussed in U.S. Pat. No. 6,074,458. Furthermore, separation can be influenced by the specific belt geometry, as disclosed in U.S. Pat. No. 5,904,253, as well as the continual wear of the belt over time. Overall, this combination of natural variation in feed quality, environmental factors and on-going wear of the belt 18 creates an environment where the process must be continually monitored and adjusted in order to maintain a certain level of separation. Usually, these adjustments affect not only the product purity, but also the yield split between the primary and secondary product effluent streams. These tradeoffs between purity and yield can lead to difficulty in optimizing separation at all times during normal operation. The yield may be defined as the percentage of the feed stream that is sent to the primary product effluent stream outlet.

Figure 2:
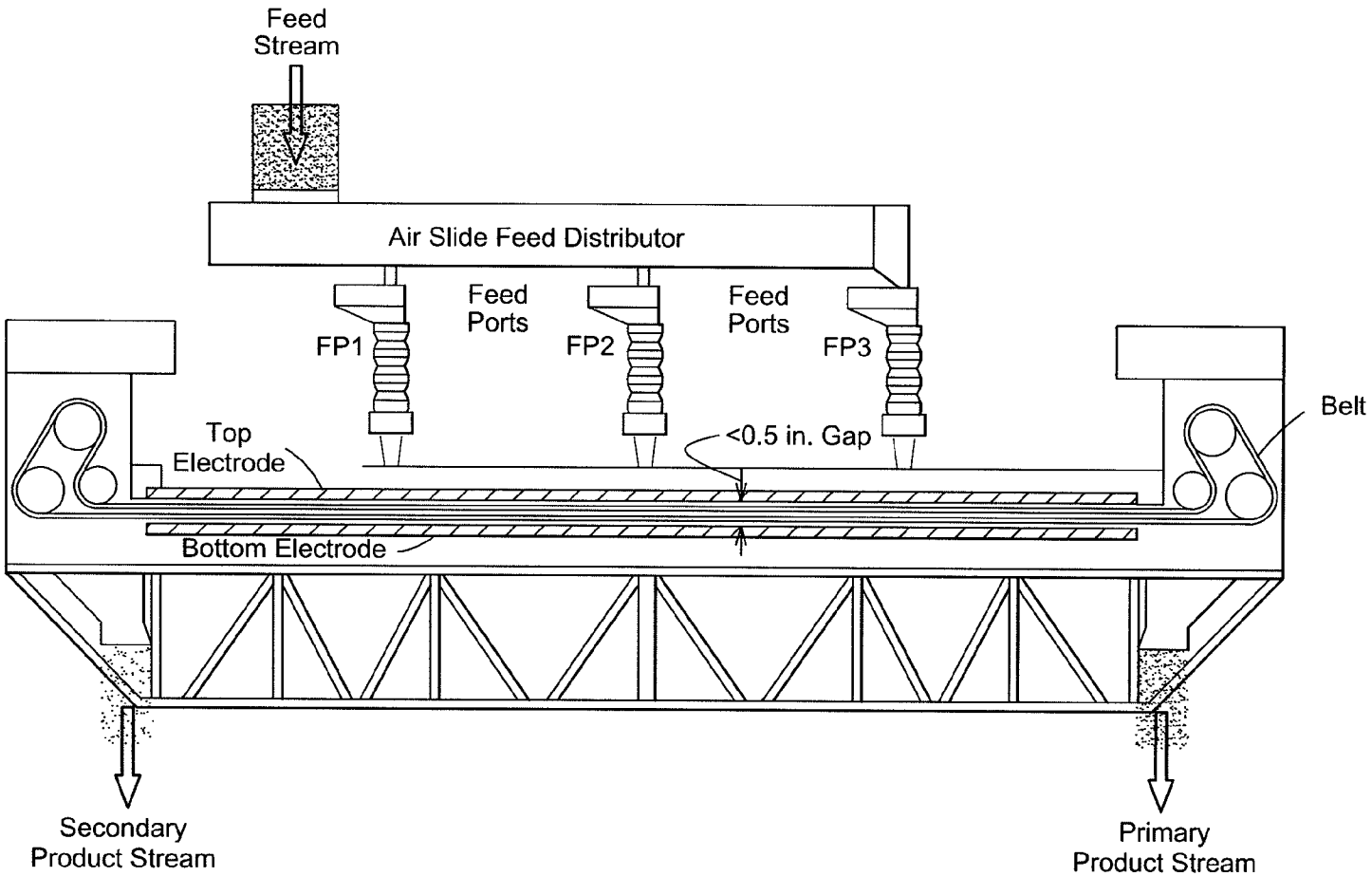
FIG. 2 is a schematic depicting a feed control system in accordance with one embodiment.

The major process variables that are utilized in practice to control the electrostatic separation process are also illustrated by considering FIG. 1. These variables include the choice of polarity of the electrodes (top positive and bottom negative or top negative and bottom positive), the speed of the belt 18 sweeping the electrodes, the gap distance in the traverse direction between the electrodes 12 and 14/16, and the overall feed rate of the particulate mixture to the system 10. In addition, another variable that may have an impact on separation is the location of the feed injection area 26. In one example of common practice, a system is utilized whereby the feed can be injected at multiple locations along the longitudinal length of the separation system, as depicted in FIG. 2. This schematic shows three possible locations for feed introduction along the longitudinal length of the separation system using a distributor airslide, which are designated as feedport 1 (FP1), feedport 2 (FP2) and feedport 3 (FP3). Here FP1 is closest to or proximate, the discharge point for the secondary product, and FP3 is closest to, or proximate, the discharge point for the primary product. However, the feedport location can be at one or more points anywhere along the longitudinal length of the separation system, including anywhere therebetween feedport 1 and feedport 2. For example, the feedport location can be a feedport location selected from the group consisting of a location proximate an outlet of the first stream, a location proximate an outlet of the second stream, a location therebetween, and combinations thereof. The optimum choice of feedport location and delivery of the particulate material to be separated to the system will vary depending on the degree of separation required, in conjunction with specific settings for the other control variables or input variables of one or more of electrode polarity, belt speed, feed rate, gap distance, and feed relative humidity.

In certain embodiments, a controller can facilitate or adjust the process variable. For example, a controller can be configured to execute the processes illustrated in the flow charts of FIGS. 3 and 6, discussed below. Through execution of these processes, the controller can adjust, for example, the belt speed, distance between electrodes, feed rate, feedport location, feed relative humidity, or any other process variable of the system, to achieve a desired output.

In one embodiment, the electrostatic separation system is operated by controlling one or more of the input variables to achieve the desired separation or to achieve a desired concentration or content of a particular component in the primary product effluent stream or a desired yield. The electrostatic separation system can be operated at a voltage between about 3 kV and 14 kV, more preferably between about 5 kV and 10 kV. The belt speed can be operated at a speed between about 10 and 70 feet per second, more preferably between about 20 and 50 feet per second. The system can be operated with a gap range of between about 200 and 1000 mils, more preferably between about 300 and 600 mils. The feed rate of the particulate material that is fed to the separation system can be between about 10 and 60 tons per hour per foot of electrode width, more preferably between about 15 and 45 tons per hour per foot of electrode width. The feed relative humidity can be between about 1 and 15 percent, more preferably between about 1 and 4 percent.

A control system that continuously or intermittently monitors the quality of the product streams, and provides at least one control system that manipulates, adjusts, or controls at least one of or a plurality of primary control variables, or input variables, in order to keep the products within target specification, while simultaneously optimizing the yield split between the primary and secondary product streams, is provided. As discussed previously, this is often difficult to accomplish using existing known technology due to the ever changing nature of the feed mixture, coupled with the complex interaction between the primary control variables.

In certain embodiments, the method for controlling processing of particulate materials using an electrostatic system comprises processing particulate material in an electrostatic separation system to recover a first stream, or a first product stream, that is diluted in at least one component of an incoming feed stream, and a second stream, or second product stream, that is concentrated in at least one component of the incoming feed. At least one input variable of the electrostatic separation process and at least one output variable indicative of at least one property of the first stream to be controlled in the electrostatic separation system can be determined. The at least one output variable can be measured at time spaced intervals, and a target range for the at least one output variable can be selected. The measured output variable can be compared with the target range to generate an output signal, and the at least one input variable can be adjusted based at least in part on the output signal. This method can be performed using a control system, and the adjustment of the at least one input variable can be accomplished automatically.

The time spaced intervals may be any interval suitable for obtaining measurements that may control the system in a desired manner, for example to achieve a desired LOI, concentration of contaminant, or yield. In certain embodiments, the intervals can be less than 20 minutes or less than 10 minutes.

Figure 3:
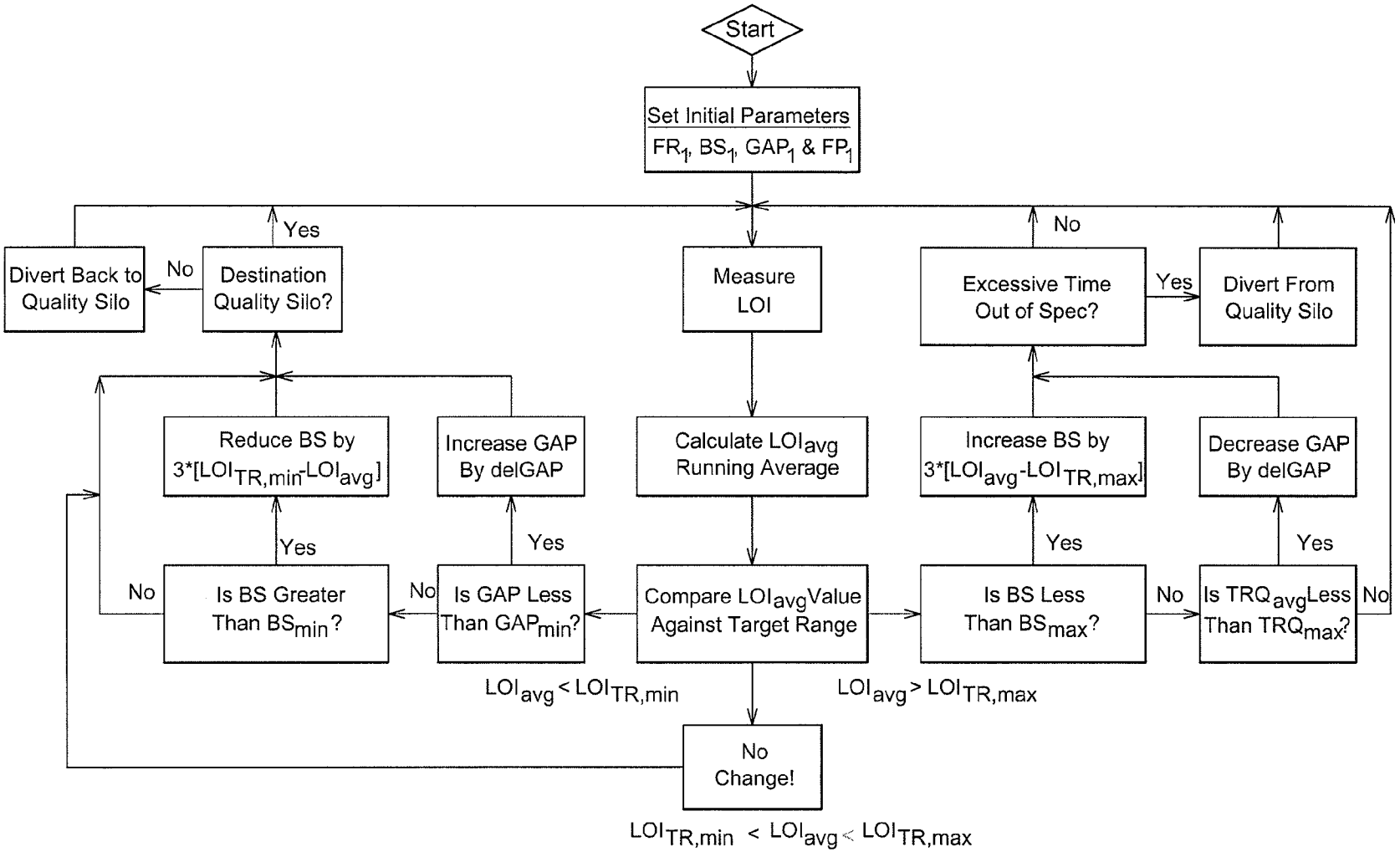
FIG. 3 is a flow chart that illustrates the procedure of a process control system for controlling product loss-on-ignition (LOI) during electrostatic separation of unburned carbon from fly ash while utilizing top-negative electrode polarity, in accordance with one embodiment.

Turning to FIG. 3, a flow chart is illustrated that conceptually describes the procedures utilized by a control system and which can be implemented by a controller for the electrostatic separator process, in accordance with one embodiment, as applied to the removal of unburned carbon from fly ash using top-negative polarity. Here the main control variables, or input variables, of the separator are feed rate (FR), belt speed (BS), electrode gap distance (GAP) and feedport location (FP). A key output variable governing separator performance is belt torque, which is continuously monitored (TRQ) and averaged ($TRQ_{avg}$). The output variable of interest in this particular control system is the loss-on-ignition (LOI), but, in other examples, can be yield, or concentration of another component such as a contaminant. The LOI can be defined as the carbon that is left unburned during the ignition in the combustion chamber of a boiler in a power plant. In certain embodiments, it is desirable to maintain the LOI at 2.5% or less. The LOI measurement provides input to the running average calculation ($LOI_{avg}$) which, in turn, is used to compare against the target range ($LOI_{min}$ to $LOI_{max}$). Other output variables can be monitored, such as yield related to the percentage of the feed stream delivered to the output of the primary product effluent stream. Adjustments to the main control variables, or input variables (del FR, del BS, delGAP, and delFP) are predicted by the control system, as illustrated in FIG. 3.

In certain embodiments, the system can use one or more of the input variables, and can adjust one or more input variables simultaneous or in sequential order. In certain embodiments, for example, the system utilizes belt speed as a first input variable that can be adjusted as a primary control parameter. Gap can be used as a second input variable that can be adjusted as a secondary control parameter, in certain embodiments, for example, if the belt speed reaches a maximum operating range. Feed rate can be used as a third input signal that can be adjusted as a tertiary control parameter, in certain embodiments, for example, if the belt speed reaches a maximum operating range, and the gap reaches a minimum operating range. The control system makes proper adjustments to keep a characteristic or property of the primary product stream, such as LOI, within a target range, while maximizing the yield of primary product produced.

Figure 6:
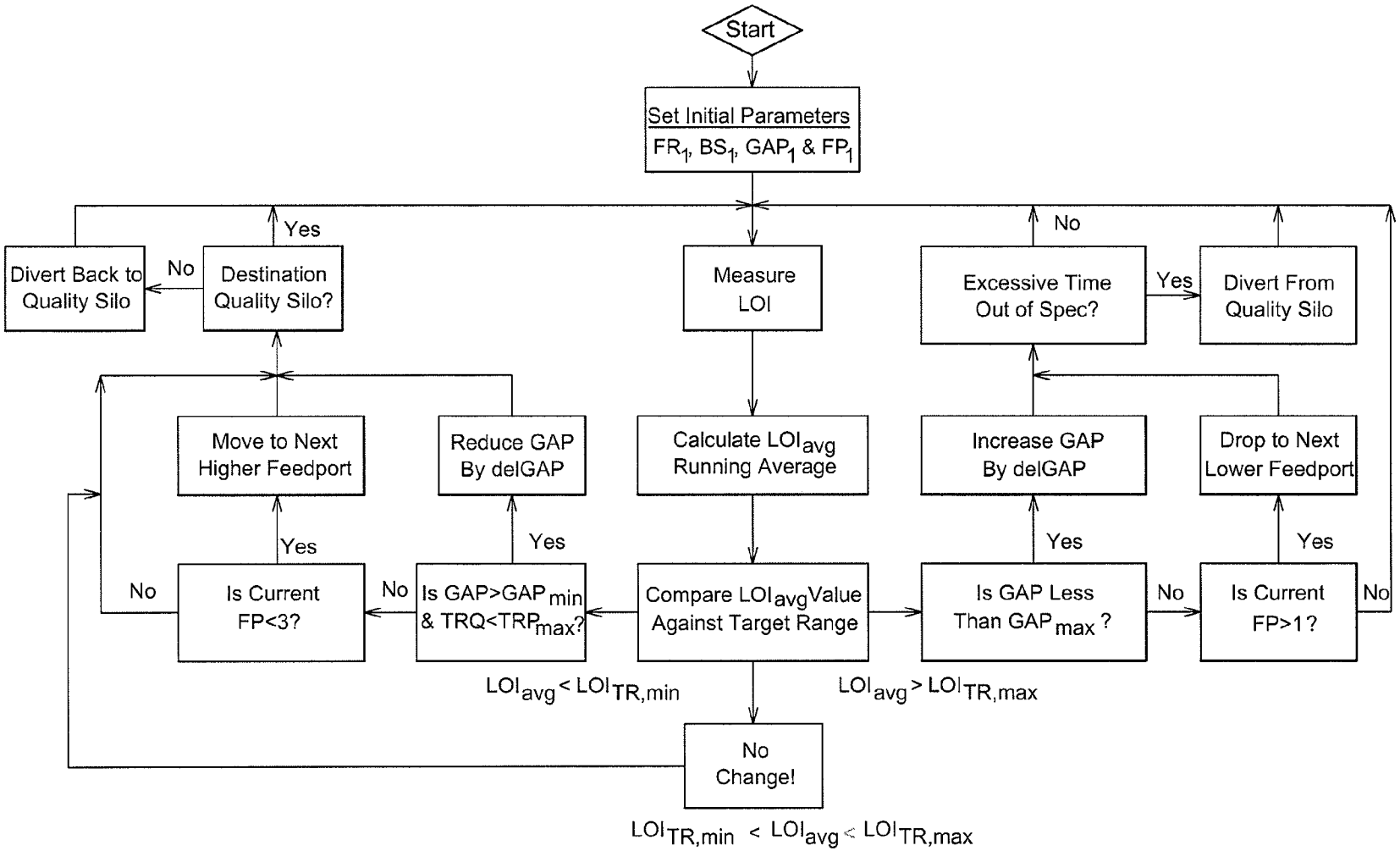
FIG. 6 is a flow chart that illustrates conceptually the procedure of a process control system for controlling product LOI during electrostatic separation of unburned carbon from fly ash while utilizing a scheme of top-positive electrode polarity, in accordance with one embodiment.

Turning to FIG. 6, another flow chart is illustrated that conceptually describes the procedures of the electrostatic separator process control system which can be implemented by a controller, as applied to the removal of unburned carbon from fly ash using top-positive polarity. This control system utilizes the same main control variables of the separator of feed rate (FR), belt speed (BS), electrode gap distance (GAP), feedport location (FP) and belt torque (TRQ and $TRQ_{avg}$). Again the output variable of interest is the LOI, along with average $LOI_{avg}$ and target range $LOI_{min}$ to $LOI_{max}$. In this case with opposite polarity, adjustments are made to the primary variables using del FR, del BS, delGAP, and delFP), as illustrated in FIG. 6. Here, the system utilizes feedport as the primary control parameter, and gap as the secondary control parameter. Again, the control system makes proper adjustments to keep the LOI of the primary product within a tight target range, while maximizing the yield of primary product produced. An automatic divert and return control is also included to assure collection of quality product under all circumstances. This example provides yet another example of the control system for electrostatic separation according to one embodiment.

Successful process control requires accurate, reliable on-line measurement of the output control variables, or output variables, of interest. In one embodiment, the on-line measurement can be achieved through the use of at least one sensor. This raw data can either be used directly (i.e., one on-line measurement) to compare against a target range or a running average of two or more measurements can be used to improve overall accuracy. Any on-line analyzer can be used to obtain a desired measurement of, for example, LOI or a concentration of component or contaminant. For example, an on-line analyzer that utilizes a high-temperature burning technique or a microwave technique for assessment of carbon content of fly ash may be used. If adjustments are indicated, the control system will determine a new set of optimum operating conditions and make changes to the major operating input variables with the goal of bringing the controlled output variables back within specification. If after a predetermined period of time the controlled output variable of interest is not within specification, the control system may divert the destination of the convey system for the primary product from the quality product destination to an off-specification location to avoid contamination of the quality product. Once indicated process changes have resulted in the quality of the primary stream to come back within specification, the control system will return the convey flow back to the quality silo. This is a significant development for assuring improved quality for the controlled process.

EXAMPLES

In accordance with an example, the control system is applied to the product application of removing unburned carbon from fly ash. In this case, the process control system is employed with a belt-type electrostatic separator, as illustrated schematically in FIGS. 1 and 2. The exemplary separator uses fly ash from a power plant burning bituminous coal in tangential-fired boilers equipped with low-NOx controls. However, it should be understood that the process control system may be used equally well with fly ashes formed from other types of feedstocks and power plant configurations. The specific separator geometry of the present example utilizes negative polarity on the top electrode panel and positive polarity on the bottom electrode. The primary product from the separator is a concentrated fly ash stream and the output variable of interest is the concentration or percentage of unburned carbon in the stream, as measured by loss-on-ignition (LOI).

For this example, the initial operating parameters included a feed rate of 35 tons per hour, a belt speed of 30 feet per second, a gap between electrodes of 0.450 inches, and a feed port location of feed port 3, as shown in FIG. 2.

An on-line LOI analyzer was used to monitor the quality of the product stream in order to provide discrete LOI measurements at time spaced intervals. A running average of three measurements was made at about four to seven minute intervals to reduce test variation and help assure representative sampling. The average value was then compared with an LOI target range comprised of an acceptable minimum target and a maximum target. No changes were made to any input variables if the measured average LOI value was within the target range. Adjustments were made to the main input variables based upon rules contained in the separator control system. This control system was determined empirically for a given separator geometry and typical incoming feed ash properties that can be influenced by coal source and the specific power plant boiler conditions as described.

As shown in FIG. 3, a flow chart is illustrated that conceptually describes the procedures utilized by the control system for the electrostatic separator process, as applied to the removal of unburned carbon from fly ash using top-negative polarity, as in this example. Here the main control variables of the separator were feed rate (FR), belt speed (BS), electrode gap distance (GAP) and feedport location (FP). A key output variable governing separator performance was belt torque, which was continuously monitored (TRQ) and averaged ($TRQ_{avg}$). The output variable was the loss-on-ignition (LOI) that provided input to the running average calculation ($LOI_{avg}$) which, in turn, was used to compare against the target range ($LOI_{min}$ to $LOI_{max}$). Adjustments to the primary variables (del FR, del BS, delGAP, and delFP) were predicted by the control system, as illustrated in FIG. 3. In general, the system utilizes belt speed as the primary control parameter, while keeping all other parameters constant. The control system made proper adjustments to keep the LOI of the primary product within a tight target range, while maximizing the yield of primary product produced. As the belt speed decreased, the product LOI increased. Additionally, as the belt speed decreased, the yield increased.

An example showing the significant product quality and yield benefits offered by the control system are provided following. A benefit of the control system that was found is the ability to quickly attain and maintain product quality within a very narrow target range, which is extremely advantageous for providing a product to potential customers with consistent product quality.

Figure 4A:
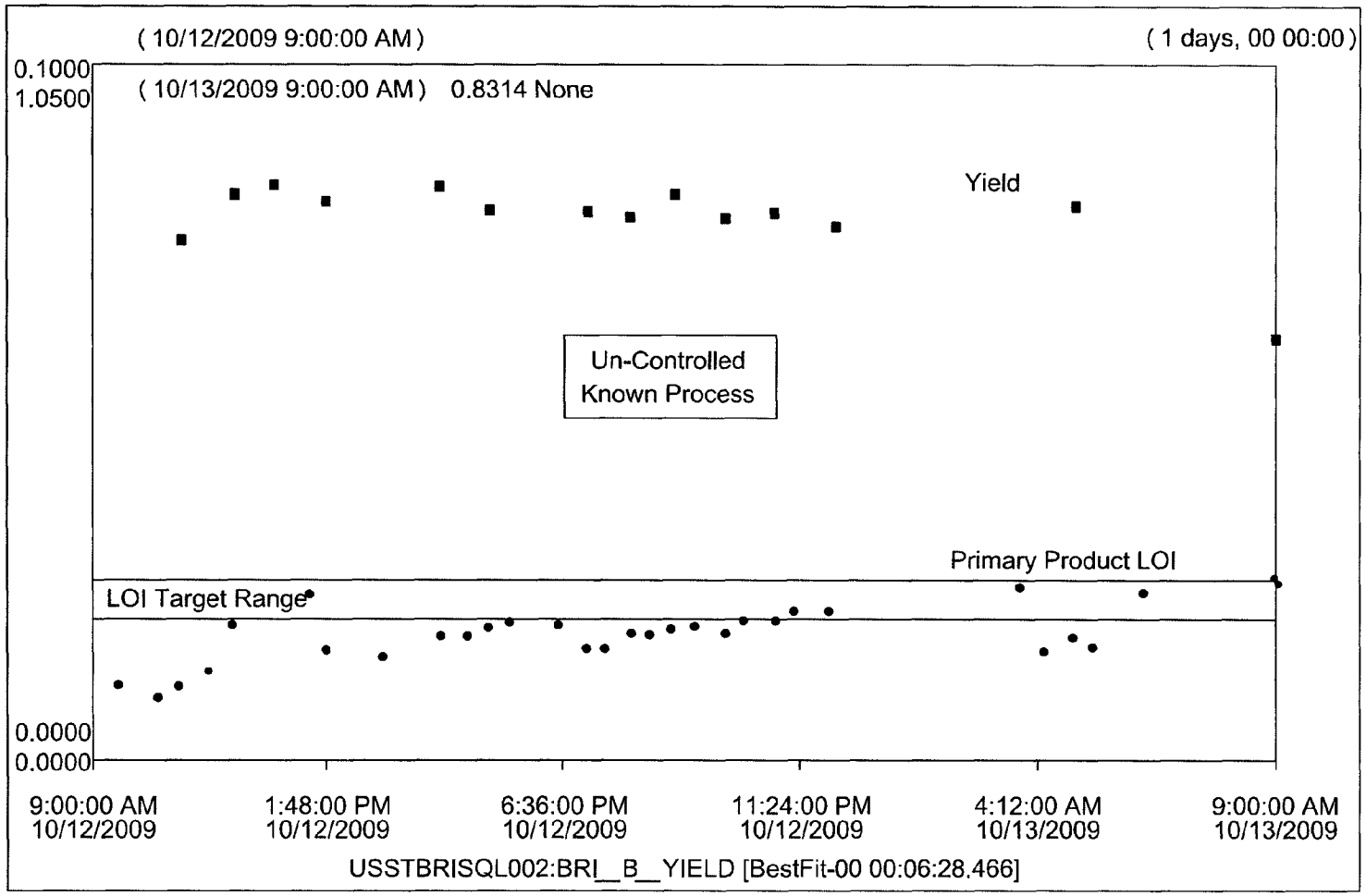
FIG. 4*a* is a histogram that illustrates the LOI and yield capability of an uncontrolled process for electrostatic separation of unburned carbon from fly ash.
Figure 4B:
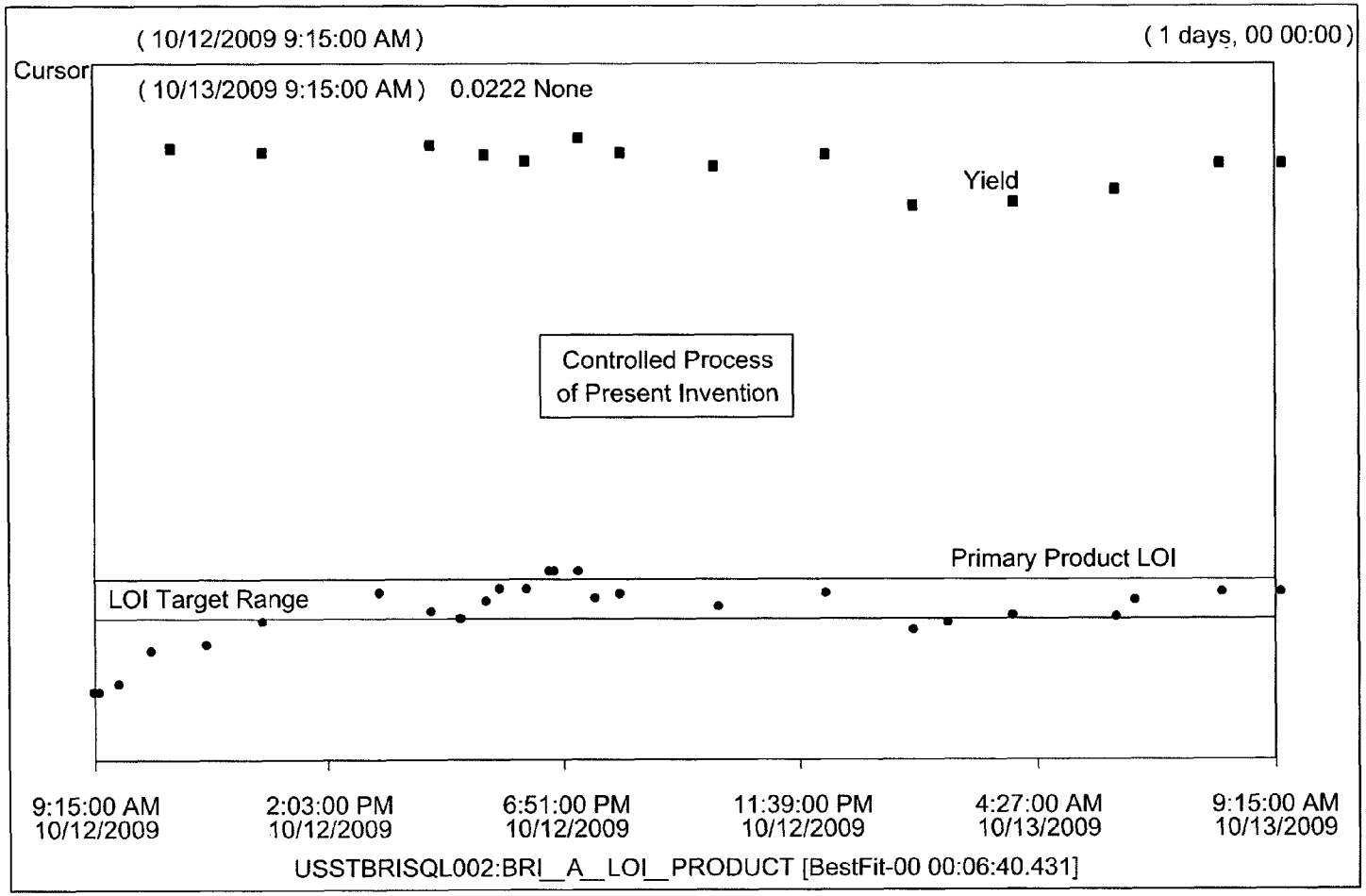
FIG. 4*b* is a histogram that compares the LOI and yield capability of a controlled process for electrostatic separation of unburned carbon from fly ash, in accordance with one embodiment.

FIG. 4*a* provides a histogram of product quality over the course of a day's commercial operation for the standard process utilizing traditional operator control, compared against a similar histogram where a separator employs the control system, as shown in FIG. 4*b*. FIG. 4*b* shows that the control system offers much quicker response and successfully maintains product quality within the target range over the course of production, while incoming feed quality is continually varying. FIG. 4*a* shows that the conventional process routinely experiences extended periods where the product quality falls outside of the target range. Since for this application out of specification production on the high side of the target is worse than operating low out-of specification, there is a natural tendency for the operators to err on the low side of the specification which is apparent in FIG. 4*a*. However, there are normally operating inefficiencies introduced by this practice resulting in sub-optimal yields. A clear advantage is offered by the control system that operates under optimum conditions at all times, leading to the significantly higher yields as demonstrated in FIG. 4*b* versus FIG. 4*a*.

Figure 5:
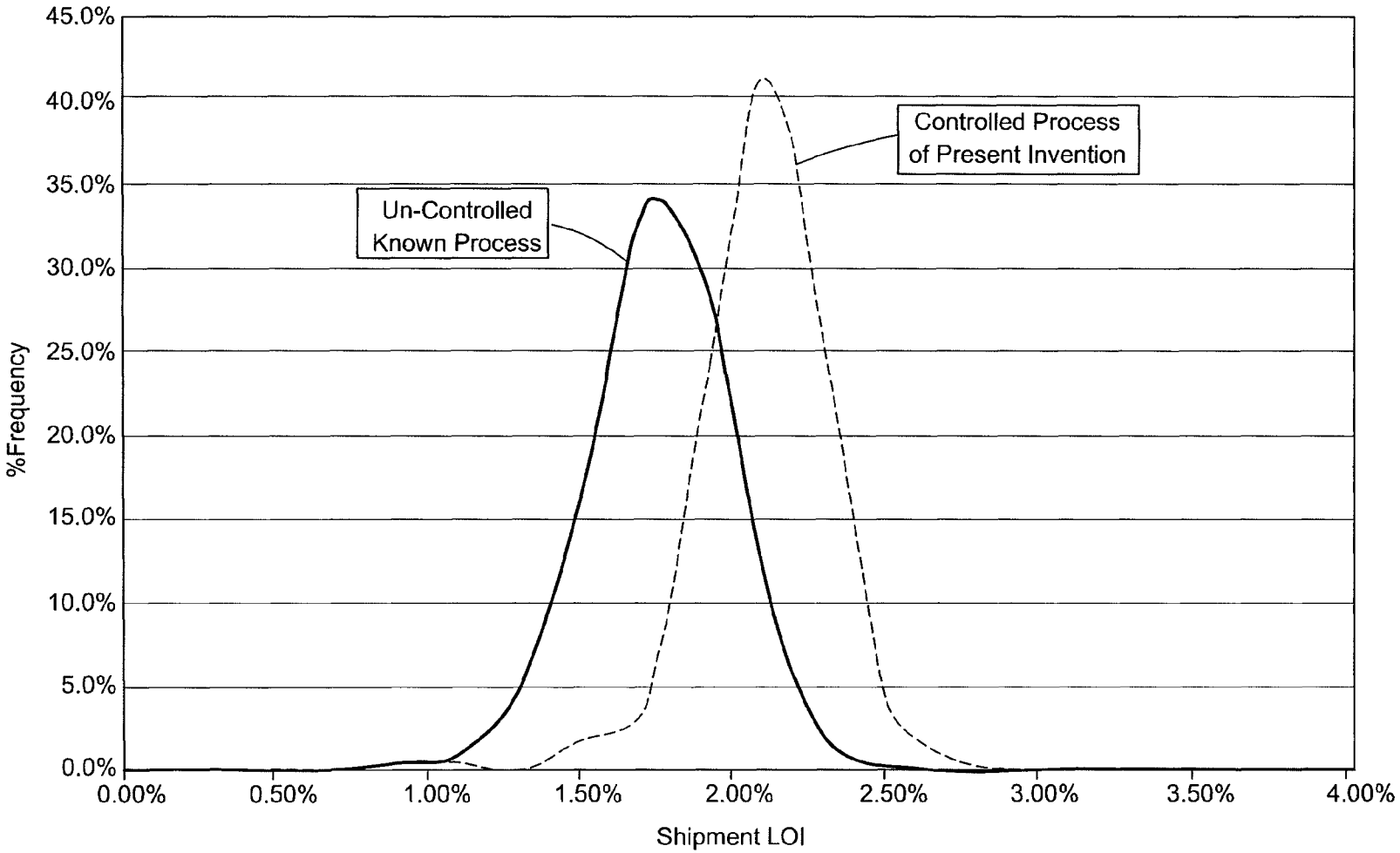
FIG. 5 is a histogram that shows the variation in LOI measurements from truck samples produced by an uncontrolled process for electrostatic separation of unburned carbon from fly ash compared against data depicting a similar chart for a controlled process, in accordance with one embodiment.

In certain embodiments, the control system can also be capable of consistently offering customers a product with constant and non-varying product quality. The desired property of a more uniform and controlled product is further illustrated in FIG. 5 which shows histograms of product LOI for a commercial plant operating with traditional operator control, along with a histogram for the same plant after full implementation of the separator control process. These distributions represent hundreds of truck samples included over the course of many months. In both cases, the desired target range for product LOI was 2.0 to 2.5 percent for this commercial operation, and the data collected for the process is seen to be centered much better within this range and with a narrower distribution as indicated by the two peaks. A further benefit of the control system is also derived from a significant reduction in operating cost for labor through implementation of automated control. In this case, direct labor was actually reduced in half for the automated facility compared to the previous operator control operation. This major improvement was achieved by reducing the number of samples that operators manually collect and conduct LOI tests on from 196/day down to less than 20 periodic check samples, along with significantly less operator attention for normal separator operation. This cost reduction is key for assuring that the electrostatic technology remains economically viable for separation applications such as this.

What is claimed is:

1. A method for controlling processing of particulate materials using an electrostatic separation system, the method comprising:

processing particulate material in a triboelectric counter-current belt-type electrostatic separation system to recover a first stream that is diluted in at least one component of an incoming feed, and a second stream that is concentrated in at least one component of the incoming feed;

determining at least one input variable of the electrostatic separation process and at least one output variable indicative of at least one property of the first stream to be controlled in the electrostatic separation system;

on-line measuring at time spaced intervals the at least one output variable from the electrostatic separation system using an on-line analyzer;

selecting a target range for the at least one output variable;

comparing the measured output variable with the target range to generate an output signal; and automatically adjusting by a control system the at least one input variable in response to a process based at least in part on the output signal.

2. The method of claim 1, wherein the at least one input variable is selected from the group consisting of polarity, voltage, belt speed, feed rate, feedport location, gap, feed relative humidity and combinations thereof.

3. The method of claim 1, wherein processing particulate material in the electrostatic separation system comprises operating at a voltage of between about 3 and 14 kV.

4. The method of claim 3, wherein the voltage is between about 5 and 10 kv.

5. The method of claim 1, wherein processing particulate material in the electrostatic separation system comprises operating a belt at a speed between about 10 and 70 feet per second.

6. The method of claim 5, wherein the speed is between about 20 and 50 feet per second.

7. The method of claim 1, wherein processing particulate material in the electrostatic separation system comprises operating the system with a gap between about 200 and 1000 mils.

8. The method of claim 7, wherein the gap is between about 300 and 600 mils.

9. The method of claim 1, wherein a feed relative humidity is between about 1 and 15 percent.

10. The method of claim 9, wherein the feed relative humidity is between about 1 and 4%.

11. The method of claim 1, wherein processing particulate material in the electrostatic separation system comprises feeding the particulate material at a feed rate of between about 3 and 17 tons per hour per foot of electrode width.

12. The method of claim 11, wherein the feed rate is between about 4 and 13 tons per hour per foot of electrode width.

13. The method of claim 1, wherein processing particulate material in the electrostatic separation system comprises delivering the particulate material to at least one feedport location.

14. The method of claim 1, wherein the output variable comprises the concentration of at least one component of the incoming feed.

15. The method of claim 14, wherein the time spaced intervals are less than 20 minutes 16. The method of claim 15, wherein the time spaced intervals are less than 10 minutes.

17. The method of claim 15, wherein said output variable is calculated as an average value of at least one on-line measurement obtained at time spaced intervals.

18. The method of claim 17, wherein said output variable under control is calculated as an average value of at least two on-line measurements obtained at time spaced intervals.

19. The method of claim 2, wherein the particulate material is fly ash from coal-fired generation containing un-burnt carbon, whereby the first stream is diluted in carbon content and the second stream is concentrated in carbon content, and the output variable is a loss-on-ignition (LOI) of the first stream.

20. The method of claim 19, wherein said output variable is the LOI and the process adjusts based at least in part on a plurality of input variables.

21. The method of claim 20, wherein the plurality of input variables are adjusted to obtain a substantially consistent LOI quality within the target range while simultaneously maximizing the yield of the first stream that is diluted in carbon content.

22. The method of claim 19, wherein the on-line analyzer utilizes a high-temperature burning technique for assessment of the carbon content of the fly ash at time spaced intervals.

23. The method of claim 19, wherein the on-line analyzer utilizes a microwave technique for assessment of the carbon content of the fly ash obtained at time spaced intervals.

24. The method of claim 19, wherein the electrostatic separation system operates with a negative polarity on a top electrode panel and a positive polarity on a bottom electrode panel.

25. The method of claim 24, wherein the incoming feed is delivered through a feedport location selected from the group consisting of a location proximate an outlet of the first stream, a location proximate an outlet of the second stream, a location therebetween, and combinations thereof.

26. The method of claim 24, wherein the process uses belt speed as a primary control variable, and is adjusted by utilizing the relationship between a target LOI minus an average value of a measured LOI over a time-spaced interval.

27. The method of claim 26, wherein the process utilizes gap as a secondary control variable if belt speed reaches a maximum operating range, and is adjusted by utilizing the relationship between the target LOI minus an average value of the measured LOI over a time spaced interval.

28. The method of claim 27, wherein the process utilizes feed rate as a tertiary control variable if belt speed reaches the maximum operating range and gap reaches a minimum operating range, and is adjusted by utilizing the relationship between the target LOI minus an average value of the measured LOI over a time spaced interval.

29. The method of claim 19, wherein the electrostatic separation system operates with positive polarity on a top electrode panel and negative polarity on a bottom electrode panel.

30. The method of claim 29, wherein the process utilizes at least one of feedport location and gap as a primary control variable, and is adjusted by utilizing the relationship between a target LOI minus an average value of a measured LOI over a time spaced interval.

31. The method of claim 29, wherein the process utilizes feed rate as a tertiary control variable if the feedport location is proximate an outlet of the second stream and the gap reaches a minimum operating range, and is adjusted by utilizing the relationship between a target LOI minus an average value of a measured LOI over time spaced intervals.

32. The method of claim 2, wherein the particulate material comprises a first component at a first percentage of a total weight of the particulate material and a second component at a second percentage of the total weight of the particulate material, wherein the first percentage is greater than the second percentage.

33. The method of claim 32, wherein the particulate material comprises at least one industrial mineral comprising at least one contaminant.

34. The method of claim 33, wherein the industrial mineral comprises a calcium carbonate containing mineral comprising at least one of calcite, limestone, marble, travertine, tufa, and chalk, and wherein the at least one contaminant comprises quartz, pyrites, dolomite, mica, graphite, sulfides, and combinations thereof, whereby the first stream is concentrated in calcium carbonate and the second stream is concentrated in the at least one contaminant, and the output variable comprises a concentration of contaminant of the first stream.

35. The method of claim 33, wherein the industrial mineral comprises talc, and wherein the at least one contaminant comprises at least one of pyrite, sulfides, graphite, carbonates, calcite, magnesite, quartz, and tremallite, whereby the first stream is concentrated in talc and the second stream is concentrated in the at least one contaminant, and the output variable comprises a concentration of contaminant of the first stream.

36. The method of claim 33, wherein the particulate material comprises potash, and wherein the at least one contaminant comprises halite and kieserite, whereby the first stream is concentrated in potash and the second stream is concentrated in the at least one contaminant, and the output variable comprises a concentration of contaminant of the first stream.

37. The method of claim 33, wherein the output variable is the concentration of contaminant of the first stream and the process adjusts based on a plurality of input variables.

38. The method of claim 37, wherein the plurality of input variables are adjusted to obtain a substantially reduced and consistent contaminant content quality within the target range while simultaneously maximizing the yield of the first product stream that is diluted in contaminant content.

39. The method of claim 38, wherein the plurality of input variables comprises polarity, belt speed, feed rate, feedport location, and gap.

40. The method of claim 32, wherein the concentration of contaminant is measured using an on-line analyzer.

41. The method of claim 33, wherein the output variable is calculated as an average value of at least one on-line contaminant measurement obtained at time spaced intervals.

42. The method of claim 41, wherein the output variable is calculated as an average value of at least two on-line contaminant measurements obtained at time spaced intervals.

43. The method as defined in claim 32, wherein the first component charges positive and the second component charges negative and the electrostatic separation system operates with positive polarity on a top electrode panel and negative polarity on a bottom electrode panel.

44. The method of claim 43, wherein the incoming feed is delivered through a feedport location selected from the group consisting of a location proximate an outlet of the first stream, a location proximate an outlet of the second stream, a location therebetween, and combinations thereof.

45. The method of claim 43, wherein the process utilizes belt speed as a primary control variable, and is adjusted by utilizing a relationship between a target value minus an average value of a measured value over a time-spaced interval.

46. The method as defined in claim 43, wherein the process utilizes gap as a secondary control variable if belt speed reaches a minimum operating range, and is adjusted by utilizing the relationship between a target value minus an average value of the measured value over a time spaced interval.

47. The method of claim 43, wherein the process utilizes feed rate as a tertiary control variable if belt speed reaches a maximum operating range and gap reaches a minimum operating range, and is adjusted by utilizing a relationship between a target value minus an average value of a measured value over a time spaced interval.

48. The method of claim 32, wherein the first component charges positive and the second component charges negative and the electrostatic separation system operates with negative polarity on a top electrode panel and positive polarity on a bottom electrode panel.

49. The method of claim 48, wherein the process uses feedport location as a primary control variable, and is adjusted by utilizing a relationship between the target value minus an average value of a measured quality over a spaced interval.

50. The method of claim 48, wherein the process uses belt speed as a secondary control variable, and is adjusted by utilizing a relationship between a target value minus an average value of a measured value over a time spaced interval.

51. The method of claim 48, wherein the process utilizes feed rate as a tertiary control variable if feedport location is proximate an outlet of the second stream and gap reaches a minimum operating range, and is adjusted by utilizing a relationship between a target value minus an average value of a measured quality over a time spaced interval.

52. The method of claim 32, wherein the first component charges negative and the second component charges positive and the electrostatic separation system operates with positive polarity on a top electrode panel and negative polarity on a bottom electrode panel.

53. The method of claim 52, wherein the process uses feedport location as a primary control variable, and is adjusted by utilizing a relationship between the target value minus an average value of a measured quality over a spaced interval.

54. The method of claim 48, wherein the process uses belt speed as a secondary control variable, and is adjusted by utilizing a relationship between a target value minus an average value of a measured value over a time spaced interval.

55. The method of claim 52, wherein the process utilizes feed rate as a tertiary control variable if feedport location is proximate an outlet of the second stream and gap reaches a minimum operating range, and is adjusted by utilizing a relationship between a target value minus an average value of a measured quality over a time spaced interval.

56. The method as defined in claim 32, wherein the first component of the mixture to be separated charges negative and the second component charges positive and the electrostatic separation system operates with negative polarity on a top electrode panel and positive polarity on a bottom electrode panel.

57. The method of claim 56, wherein the incoming feed is delivered through a feedport location selected from the group consisting of a location proximate an outlet of the first stream, a location proximate an outlet of the second stream, a location therebetween, and combinations thereof.

58. The method of claim 56, wherein the process utilizes belt speed as a primary control variable, and is adjusted by utilizing a relationship between a target value minus an average value of a measured value over a time-spaced interval.

59. The method as defined in claim 56, wherein the process utilizes gap as a secondary control variable if belt speed reaches a minimum operating range, and is adjusted by utilizing the relationship between a target value minus an average value of the measured value over a time spaced interval.

60. The method of claim 56, wherein the process utilizes feed rate as a tertiary control variable if belt speed reaches a maximum operating range and gap reaches a minimum operating range, and is adjusted by utilizing a relationship between a target value minus an average value of a measured value over a time spaced interval.

61. The method of claim 2, further comprising delivering the first stream to an off-quality location.

62. The method of claim 61, wherein delivering the first stream to an off-quality location is based at least in part on comparing the measured output variable with the target range.

63. An apparatus for separating particulate mixtures comprising:

a feed point configured to receive particulate material;

a triboelectric counter-current belt-type electrostatic separation system;

an on-line sensor in fluid communication with the particulate material and configured to measure an output variable of the particulate material; and a controller operatively coupled to receive an output signal from the on-line sensor based at least in part on the measured output variable and control at least one input variable of the electrostatic separation system based at least in part on the output signal.

64. The apparatus of claim 63, further comprising a recycle line fluidly connected to an outlet of the electrostatic separation system and an inlet of the system.

65. The apparatus of claim 64, wherein the outlet of the electrostatic separation system is a primary product outlet.

66. The apparatus of claim 63, further comprising a source of particulate material from a system located upstream of the electrostatic separation system.

67. The apparatus of claim 63, wherein the at least one input variable is selected from the group consisting of polarity, belt speed, feed rate, feedport location, and gap.

68. The apparatus of claim 63, wherein the particulate material is fly ash from coal-fired generation comprising unburnt carbon.

69. The apparatus of claim 63, wherein the on-line sensor measures loss-on-ignition (LOI) of a stream at an outlet of the electrostatic separation system.

70. A computer readable medium including computer readable signals stored thereon defining instructions that, as a result of being executed by a controller, instruct the controller to perform a method of controlling processing of particulate materials using a triboelectric counter-current belt-type electrostatic separation system comprising:

on-line measuring an output variable using an on-line analyzer;

comparing the output variable to a target range;

generating an output signal based on the at least one output variable and the target range; and adjusting at least one input variable based at least in part on the output.

* * * * *